US007117772B2

(12) United States Patent
Chang

(10) Patent No.: US 7,117,772 B2
(45) Date of Patent: Oct. 10, 2006

(54) WRENCH HAVING A SAFETY DEVICE

(76) Inventor: Chuck Chang, No. 176-3, Guangming Rd., Taichung 407 (TW)

( * ) Notice: Subject to any disclaimer, the term of this patent is extended or adjusted under 35 U.S.C. 154(b) by 0 days.

(21) Appl. No.: 11/101,535

(22) Filed: Apr. 8, 2005

(65) Prior Publication Data

US 2005/0172763 A1 Aug. 11, 2005

Related U.S. Application Data

(63) Continuation-in-part of application No. 10/614,303, filed on Jul. 5, 2003, now abandoned.

(51) Int. Cl.
*B25B 23/14* (2006.01)
*B25B 23/16* (2006.01)

(52) U.S. Cl. ..... 81/467; 81/177.1; 81/184; 81/185.2; 81/DIG. 5

(58) Field of Classification Search ..... 81/467, 81/477, 177.1, 177.2, 184, 185.2, 489, DIG. 5
See application file for complete search history.

(56) References Cited

U.S. PATENT DOCUMENTS 3,276,296 A * 10/1966 Woods ..... 81/467
5,099,726 A * 3/1992 Hsiao ..... 81/459
5,199,336 A * 4/1993 Wuilmart ..... 81/436
5,662,012 A * 9/1997 Grabovac ..... 81/483
6,092,442 A * 7/2000 Macor ..... 81/180.1
6,408,721 B1 * 6/2002 Lee ..... 81/60
6,691,595 B1 * 2/2004 Hsien ..... 81/124.5

* cited by examiner

*Primary Examiner*—Debra S Meislin
(74) *Attorney, Agent, or Firm*—Rosenberg, Klein & Lee

(57) ABSTRACT

A wrench includes a shank having a drive head, a handle slidably mounted on the shank, and a resistance member mounted between the shank and the handle to provide a resistance to damp movement of the handle. Thus, when a force is applied on the handle to rotate the shank about the drive head, the force produces an axial component force which drives the handle to move relative to the shank, so that the resistance member is compressed, and the handle is moved on the shank to a determined position. In addition, the shank is provided with an indication portion to indicate a safety parameter of motion of the handle during movement of the handle.

14 Claims, 10 Drawing Sheets

WRENCH HAVING A SAFETY DEVICE

CROSS-REFERENCES TO RELATED APPLICATIONS

The present invention is a continuation-in-part application of the U.S. application Ser. No. 10/614,303, filed on Jul. 5, 2003 now abandoned.

BACKGROUND OF THE INVENTION

1. Field of the Invention

The present invention relates to a wrench, and more particularly to a wrench having a safety device.

2. Description of the Related Art

A conventional wrench comprises a shank having an end provided with a drive head, and an adjustable torque mechanism mounted in the shank. The adjustable torque mechanism includes a compression spring mounted in the shank and having an end rested on the locking teeth of the drive head. In operation, the torque of the adjustable torque mechanism is preset, so that when the torque of the drive head exerted on a workpiece exceeds the preset value during operation of the wrench, the locking teeth of the drive head slip, so that the drive head cannot operate the workpiece, thereby providing a safety effect. However, the adjustable torque mechanism is hidden in the shank, so that the user cannot observe operation of the adjustable torque mechanism and easily exerts an excessive force on the wrench, thereby wearing the locking teeth of the drive head.

The closest prior art references of which the applicant is aware are disclosed in Taiwan Patent No. 488354 and U.S. Pat. No. 6,092,442 to Macor.

SUMMARY OF THE INVENTION

The primary objective of the present invention is to provide a wrench having a safety device.

Another objective of the present invention is to provide a wrench, wherein the size indication mark indicates the maximum tolerance torque of the workpiece to limit the range of the applied force, so that the applied force is stopped before reaching the preset safety value, thereby preventing the workpiece from being deformed or broken, so as to achieve the safety purpose.

A further objective of the present invention is to provide a wrench comprising a resistance member mounted between the shank and the handle, so that the wrench has a simplified structure, thereby decreasing costs of fabrication.

A further objective of the present invention is to provide a wrench, wherein when the force applied on the workpiece is increased, the handle is moved on the shank away from the drive head, so that the resistance member is further compressed, and the force arm of the applied force is increased, thereby facilitating the user operating and rotating the workpiece.

A further objective of the present invention is to provide a wrench, wherein the size indication mark simultaneously indicates the maximum tolerance torque of the workpiece during movement of the handle, thereby facilitating the user operating the workpiece.

Further benefits and advantages of the present invention will become apparent after a careful reading of the detailed description with appropriate reference to the accompanying drawings.

DETAILED DESCRIPTION OF THE INVENTION

Figure 1:
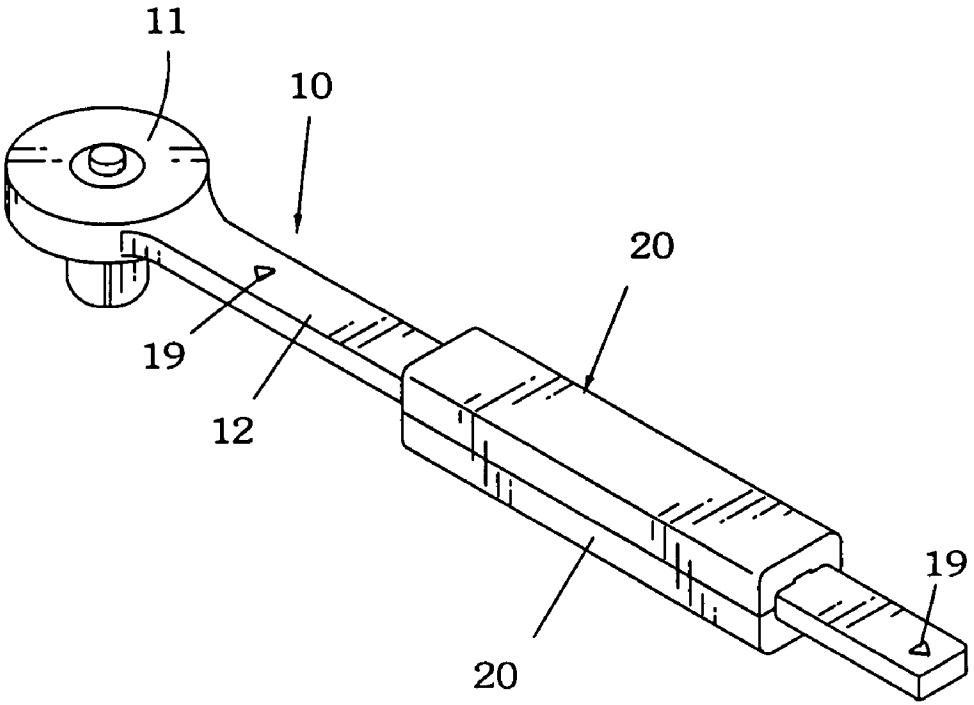
FIG. 1 is a perspective view of a wrench in accordance with the preferred embodiment of the present invention.

Referring to the drawings and initially to FIGS. 1–5, a wrench 10 having a safety device in accordance with the preferred embodiment of the present invention comprises a shank 12 having an end provided with a drive head 11, a handle 20 slidably mounted on the shank 12, and a resistance member 30 mounted between the shank 12 and the handle 20 to provide a resistance to damp movement of the handle 20. In operation, when a force is applied on the handle 20 to rotate the shank 12 about the drive head 11, the force produces an axial component force which drives the handle 20 to move relative to the shank 12, so that the resistance member 30 is compressed, and the handle 20 is moved on the shank 12 to a determined position.

Figure 4:
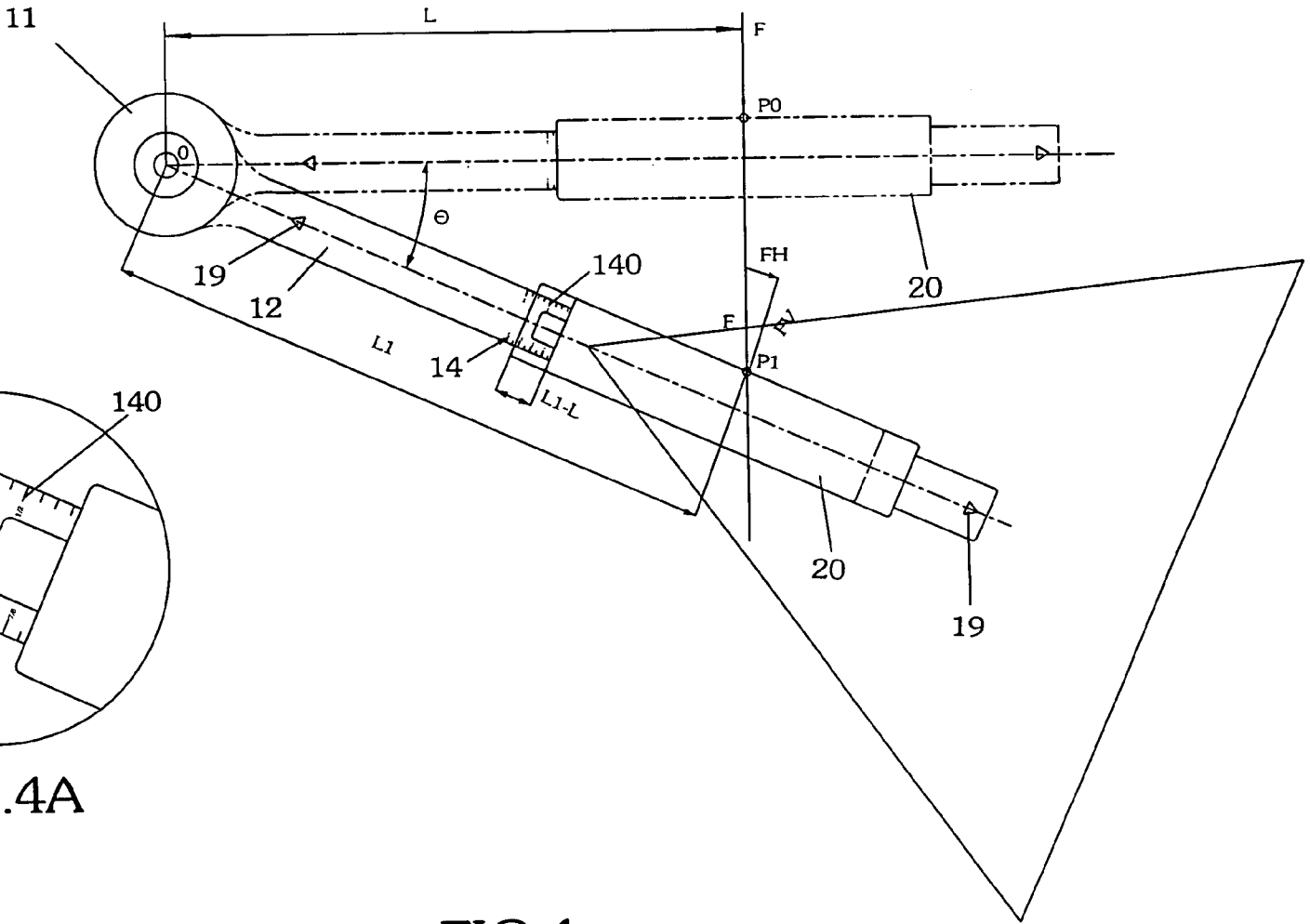
FIG. 4 is a top plan operational view of the wrench as shown in FIG. 1.
Figure 4A:
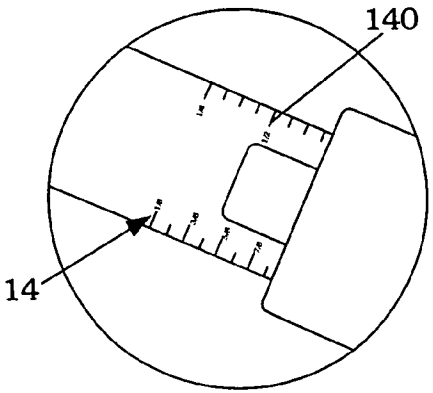
FIG. 4A is a locally enlarged view of the wrench as shown in FIG. 4.
Figure 6:
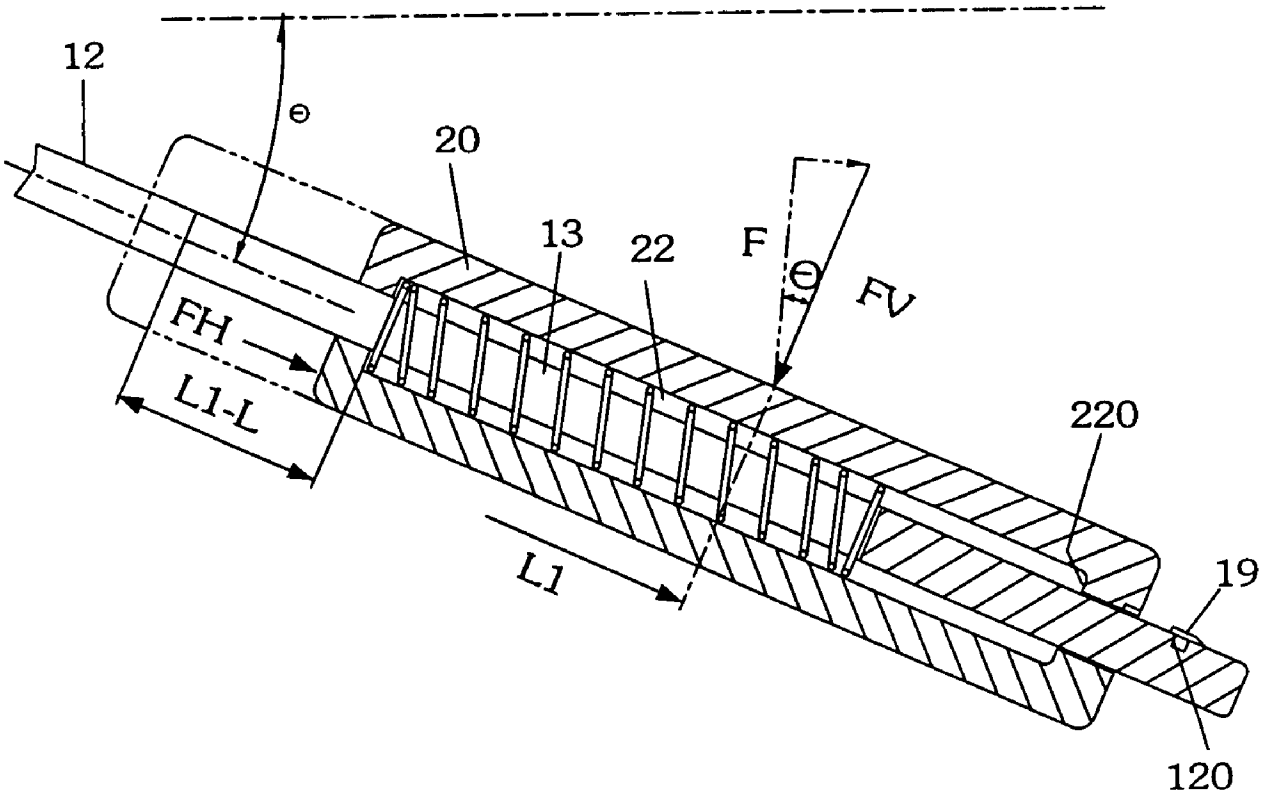
FIG. 6 is a partially cut-away plan cross-sectional operational view of the wrench as shown in FIG. 1.

The shank 12 is formed with an elongated receiving slot 13 to receive the resistance member 30. The shank 12 is provided with an indication portion 14 having a plurality of size indication marks 140 to indicate the safety parameters of motion of the handle 20, thereby providing a safety effect. The indication portion 14 is located adjacent to the receiving slot 13 of the shank 12. The size indication mark 140 (see FIG. 4A) indicates the maximum torque tolerance of the workpiece driven by the drive head 11, and the position of the size indication mark 140 is measured corresponding to the applied force. The shank 12 has two ends each provided with a protruding stop mark 19 to limit further movement of the handle 20. Each of the two ends of the shank 12 is formed with a positioning hole 120 for positioning the respective stop mark 19. The receiving slot 13 of the shank 12 has a length smaller than that of the indication portion 14, thereby preventing the receiving slot 13 from being exposed outward during movement of the handle 20.

Figure 3:
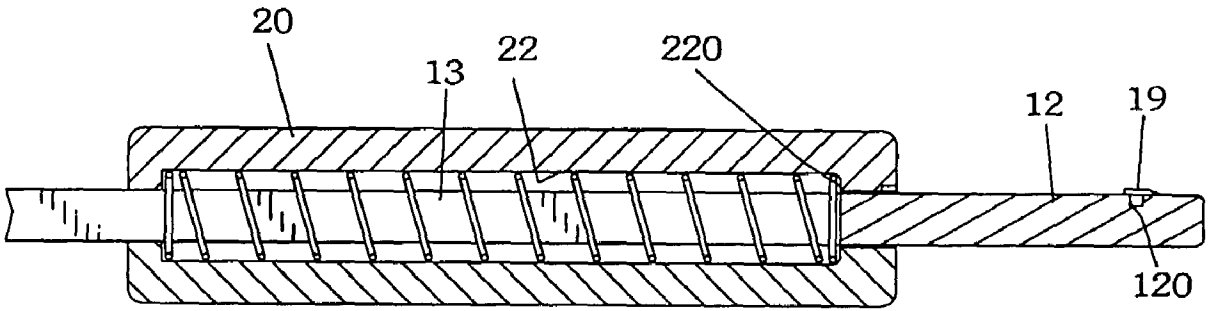
FIG. 3 is a partially cut-away plan cross-sectional view of the wrench as shown in FIG. 1.
Figure 5:
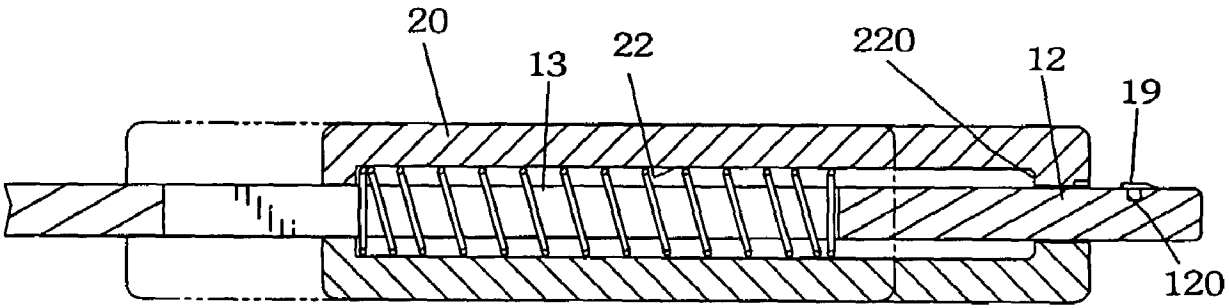
FIG. 5 is an operational view of the wrench as shown in FIG. 3.

The resistance member 30 is mounted in the receiving slot 13 of the shank 12 and has a top portion and a bottom portion each protruded outward from the receiving slot 13 of the shank 12 and each locked in the handle 20 as shown in FIG. 3. Preferably, the resistance member 30 is a compression spring.

The handle 20 includes two covers 21 combined with each other and each slidably mounted on the shank 12. The handle 20 is formed with two opposite semi-circular receiving grooves 22 to receive the top portion and the bottom portion of the resistance member 30 respectively. Each of the receiving grooves 22 of the handle 20 has two closed ends each provided with a resting portion 220 to retain an end of the resistance member 30.

Figure 2:
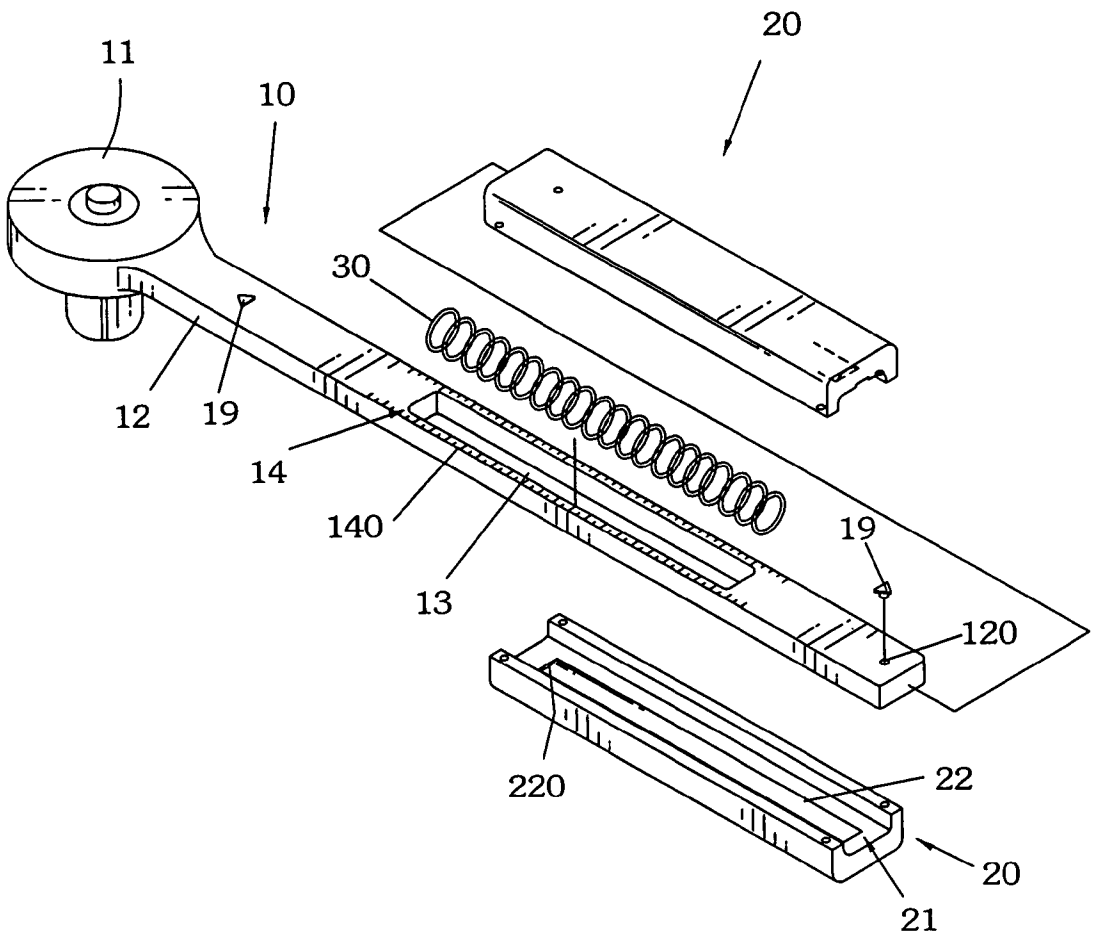
FIG. 2 is an exploded perspective view of the wrench as shown in FIG. 1.

In practice, referring to FIGS. 4–7 with reference to FIGS. 1–3, when a force F (the force F is perpendicular to the center of the handle 20) is applied on the handle 20 to rotate the shank 12 about the center O of the drive head 11 through an inclined angle θ, the force F produces an axial component force FH and a transverse component force FV. Thus, the axial component force FH drives the handle 20 to move on the shank 12 away from the drive head 11, so that the resistance member 30 is compressed, and the applied force arm of the force F is increased from L to L1.

When the track of the handle 20 is moved from P0 to P1 to reach the rated force of the force F, the size indication mark 140 indicates the maximum torque tolerance of the workpiece driven by the drive head 11. At this time, the maximum torque tolerance of the workpiece is equal to the transverse component force FV multiplying the applied force arm L1 (FV*L1). The axial component force FH is proportional to the compressed value of the resistance member 30. Thus, by calculation of the compressed value of the resistance member 30, the axial component force FH and the transverse component force FV can be calculated, so that the value of the force F can be calculated and the position of the size indication mark 140 is calculated so as to indicate the value of the force F. Thus, the position of the size indication mark 140 is indicated.

Figure 7:
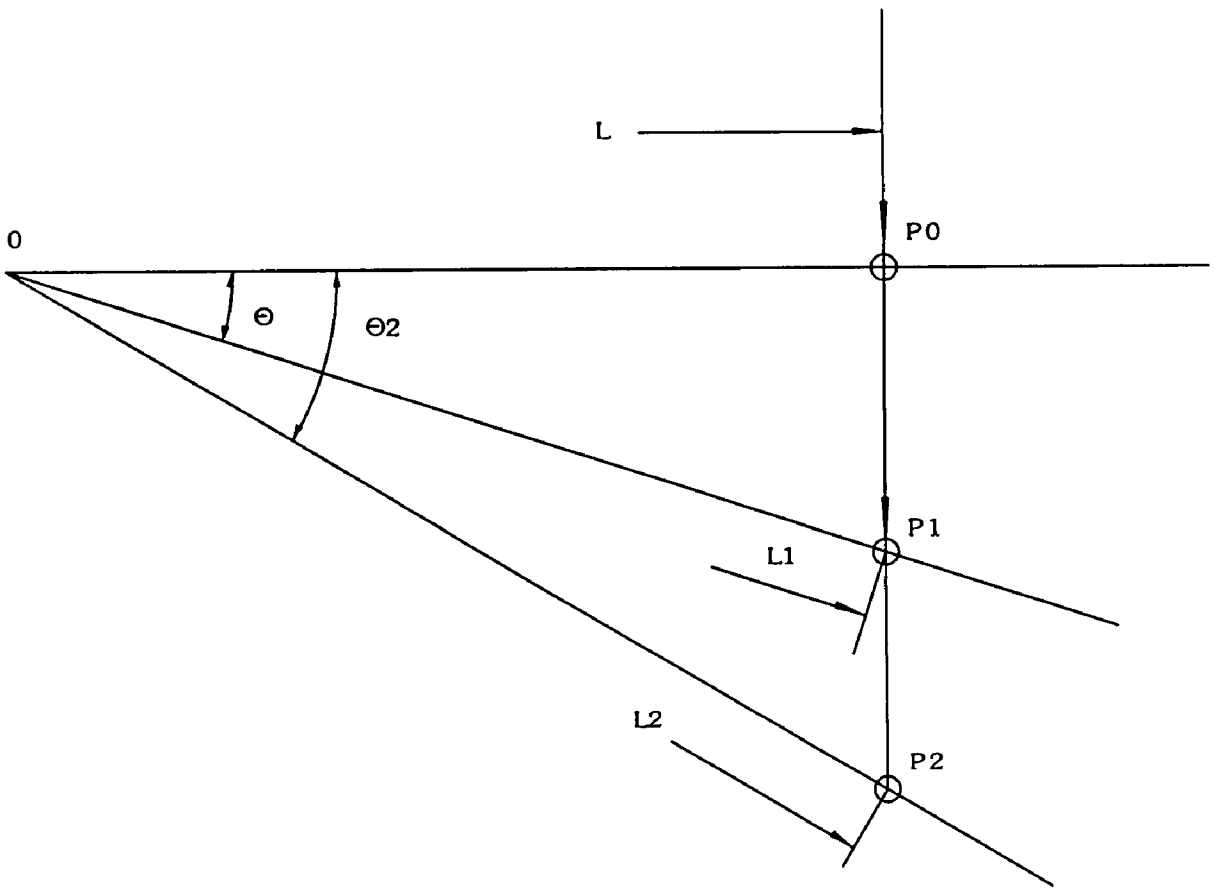
FIG. 7 is a schematic plan view of the operational track of the wrench as shown in FIG. 1.

If the applied force is smaller than the force F, the position of the size indication mark 140 will not appear, and if the applied force is greater than or equal to the force F, the position of the size indication mark 140 will be indicated. Thus, when the rated tolerance of the force F is not reached, the shank 12 is rotated about the center O of the drive head 11 through an inclined angle θ2, and the track of the handle 20 is still moved to P2 to reach the applied force arm L2 as shown in FIG. 7.

Accordingly, the wrench 10 in accordance with the preferred embodiment of the present invention has the following advantages.

1. The size indication mark 140 indicates the maximum tolerance torque of the workpiece to limit the range of the applied force, so that the applied force is stopped before reaching the preset safety value, thereby preventing the workpiece from being deformed or broken so as to achieve the safety purpose.

2. The wrench 10 comprises a resistance member 30 mounted between the shank 12 and the handle 20, so that the wrench 10 has a simplified structure, thereby decreasing costs of fabrication.

3. When the force applied on the workpiece is increased, the handle 20 is moved on the shank 12 away from the drive head 11, so that the resistance member 30 is further compressed, and the force arm of the applied force is increased, thereby facilitating the user operating and rotating the workpiece.

4. The size indication mark 140 indicates the maximum tolerance torque of the workpiece simultaneously during movement of the handle 20, thereby facilitating the user operating the workpiece.

Figure 8:
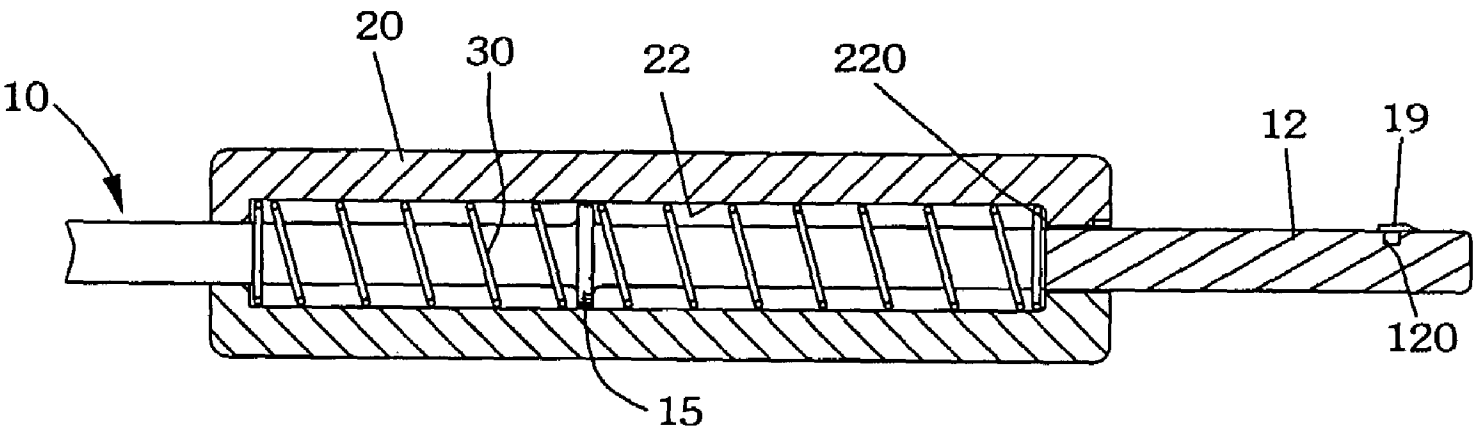
FIG. 8 is a partially cut-away plan cross-sectional operational view of a wrench in accordance with another preferred embodiment of the present invention.

Referring to FIG. 8, the resistance members 30 is enclosed around an outer wall of the shank 12 and biased between the handle 20 and the shank 12. The outer wall of the shank 12 is formed with a protruding resting portion 15 extending outward into the two receiving grooves 22 of the handle 20. The resistance members 30 is locked on the resting portion 15 of the shank 12 and has two ends each rested on the respective resting portion 220 of each of the receiving grooves 22 of the handle 20.

Figure 9:
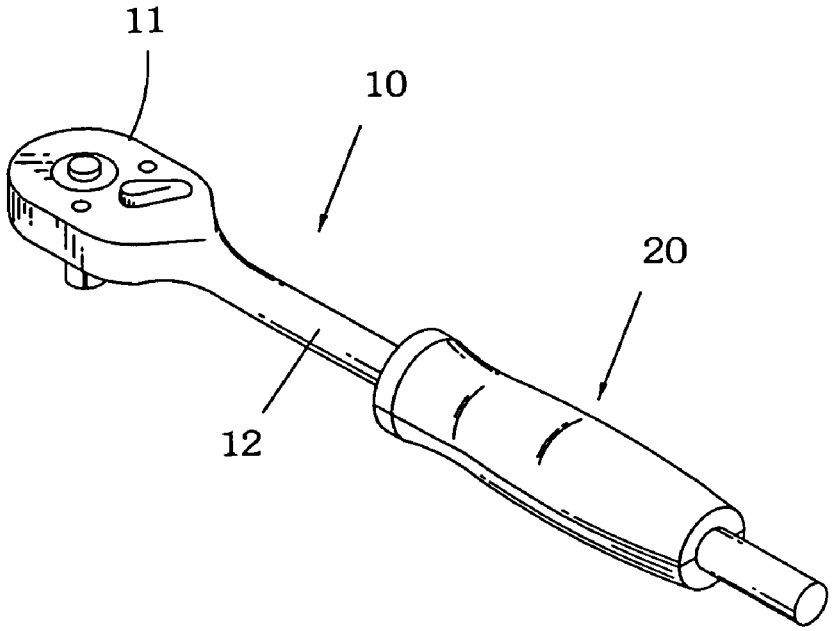
FIG. 9 is a perspective view of a wrench in accordance with another embodiment of the present invention.

Referring to FIG. 9, the handle 20 is mounted on a ratchet wrench and has a cylindrical shape.

Figure 10:
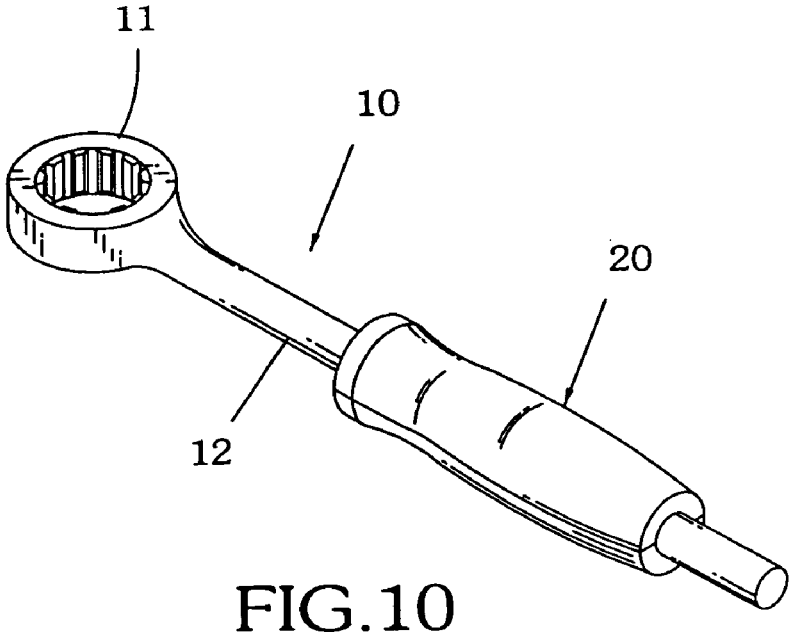
FIG. 10 is a perspective view of a wrench in accordance with another embodiment of the present invention.

Referring to FIG. 10, the handle 20 is mounted on a box-ended wrench and has a cylindrical shape.

Figure 11:
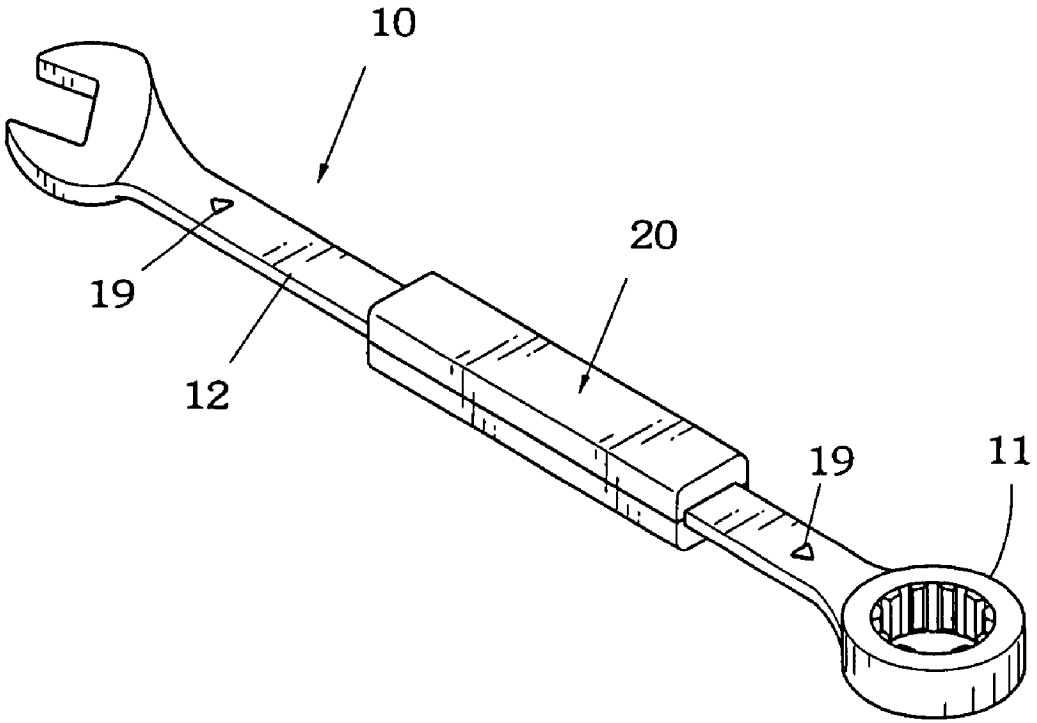
FIG. 11 is a perspective view of a wrench in accordance with another embodiment of the present invention.

Referring to FIG. 11, the handle 20 is mounted on a combination wrench and has a rectangular shape.

Figure 12:
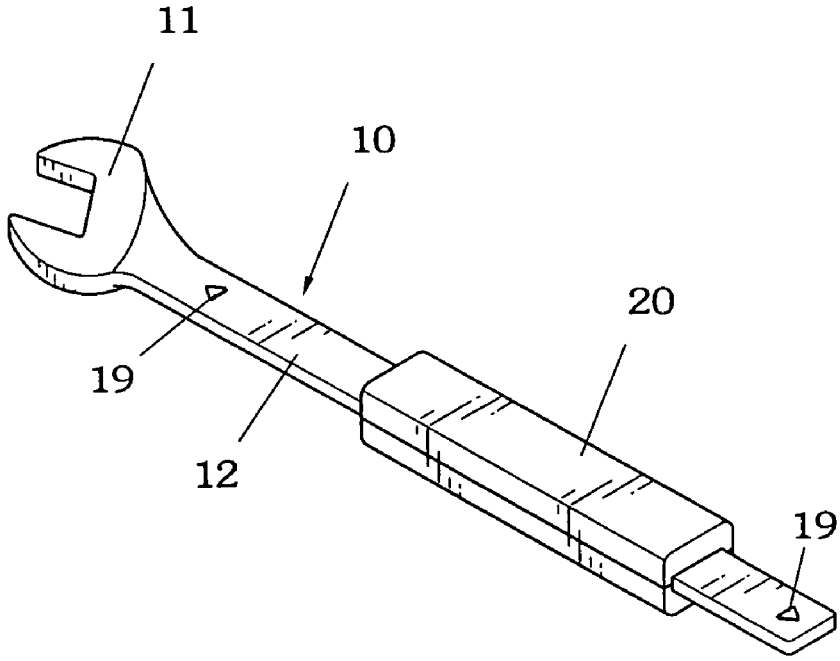
FIG. 12 is a perspective view of a wrench in accordance with another embodiment of the present invention.

Referring to FIG. 12, the handle 20 is mounted on an open-ended wrench and has a rectangular shape.

Figure 13:
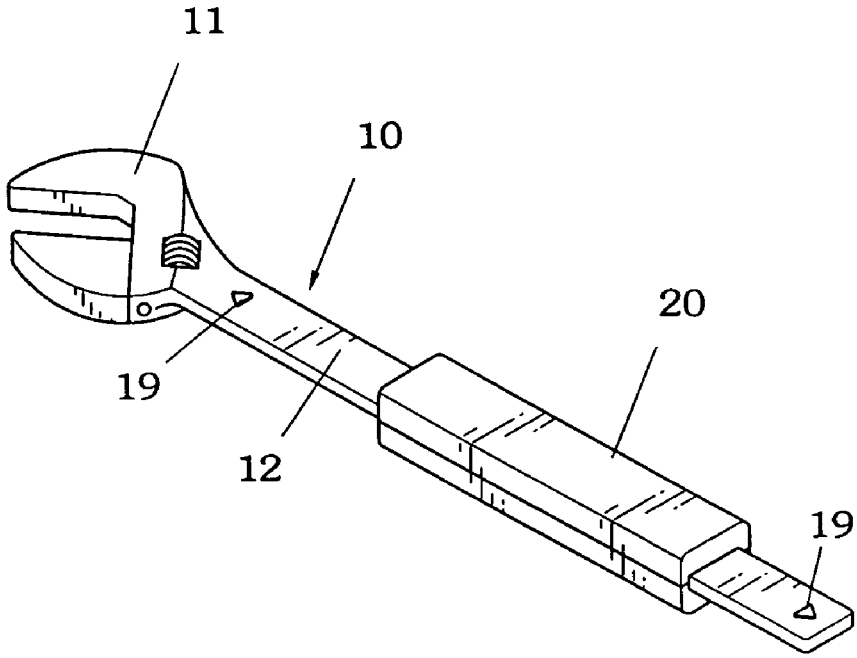
FIG. 13 is a perspective view of a wrench in accordance with another embodiment of the present invention.

Referring to FIG. 13, the handle 20 is mounted on an adjustable wrench and has a rectangular shape.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench, comprising:

a shank having an end provided with a drive head;

a handle axially and slidably mounted on the shank;

a resistance member mounted between the shank and the handle to provide a resistance to damp movement of the handle; wherein:

the resistance member is positioned on the shank and has a portion protruded outward from the shank and pressed by the handle;

when a force is applied on the handle to rotate the shank about the drive head, the force produces an axial component force which drives the handle to move relative to the shank, so that the resistance member is compressed, and the handle is moved on the shank to a determined position;

the shank is provided with an indication portion to indicate a safety parameter of motion of the handle during movement of the handle.

2. The wrench in accordance with claim 1, wherein the indication portion of the shank has a plurality of size indication marks to indicate the safety parameter of motion of the handle during movement of the handle.

3. The wrench in accordance with claim 1, wherein the shank is formed with an elongated receiving slot, and the resistance member is received in the receiving slot of the shank.

4. The wrench in accordance with claim 3, wherein the indication portion of the shank is located adjacent to the receiving slot of the shank.

5. The wrench in accordance with claim 3, wherein the resistance member has a top portion and a bottom portion each protruded outward from the receiving slot of the shank and each locked in the handle.

6. The wrench in accordance with claim 5, wherein the handle is formed with two opposite semi-circular receiving grooves to receive the top portion and the bottom portion of the resistance member respectively.

7. The wrench in accordance with claim 6, wherein each of the receiving grooves of the handle has two closed ends each provided with a resting portion to retain an end of the resistance member.

8. The wrench in accordance with claim 3, wherein the receiving slot of the shank has a length smaller than that of the indication portion, thereby preventing the receiving slot from being exposed outward during movement of the handle.

9. The wrench in accordance with claim 1, wherein the shank has two ends each provided with a protruding stop mark to limit movement of the handle.

10. The wrench in accordance with claim 9, wherein each of the two ends of the shank is formed with a positioning hole for positioning the respective stop mark.

11. The wrench in accordance with claim 1, wherein the resistance member is enclosed around an outer wall of the shank and biased between the handle and the shank.

12. The wrench in accordance with claim 11, wherein the outer wall of the shank is formed with a protruding resting portion, and the resistance members is locked on the resting portion of the shank.

13. The wrench in accordance with claim 12, wherein the handle is formed with two opposite semi-circular receiving grooves to receive the resistance member, and the resting portion of the shank is extended outward into the two receiving grooves of the handle.

14. The wrench in accordance with claim 13, wherein each of the receiving grooves of the handle has two closed ends each provided with a resting portion, and the resistance members has two ends each rested on the respective resting portion of each of the receiving grooves of the handle.

* * * * *